US006489729B1

(12) United States Patent
Erhardt et al.

(10) Patent No.: US 6,489,729 B1
(45) Date of Patent: Dec. 3, 2002

(54) AUXILIARY LIGHTING SYSTEM FOR HIGH INTENSITY DISCHARGE LAMP

(75) Inventors: Robert Erhardt, Schaumburg, IL (US); Ching-Yao Hung, Palatine, IL (US); Raymond Kulka, Chicago, IL (US); Seymour Perkins, III, Hinsdale, IL (US); Oscar Deurloo, Arlington Heights, IL (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/878,833

(22) Filed: Jun. 11, 2001

(51) Int. Cl.[7] ..... H05B 37/02

(52) U.S. Cl. ..... 315/209 R; 315/291; 315/307; 315/244; 315/194; 362/20; 314/1

(58) Field of Search ..... 315/209 R, 291, 315/307, 224, 194, 88, 91, 92; 362/20, 11, 13; 314/1

(56) References Cited

U.S. PATENT DOCUMENTS

| | | | | |
|---|---|---|---|---|
| 3,737,720 A | | 6/1973 | Willis, Jr. | 315/91 |
| 3,890,534 A | | 6/1975 | Horowitz | 315/92 |
| 3,927,348 A | | 12/1975 | Zawadski | 315/88 |
| 4,246,515 A | * | 1/1981 | Schauffele | 315/290 |
| 4,453,123 A | * | 6/1984 | Erkman | 323/324 |
| 4,996,463 A | | 2/1991 | Horowitz | 315/250 |
| 5,012,392 A | * | 4/1991 | Hochstein | 362/4 |
| 5,115,165 A | | 5/1992 | Knoble | 315/92 |
| 5,256,946 A | | 10/1993 | Garbowicz et al. | 315/88 |
| 5,990,631 A | * | 11/1999 | Hioki et al. | 315/241 P |
| 6,072,286 A | | 6/2000 | Sears | 315/313 |
| 6,307,330 B1 | * | 10/2001 | So | 315/291 |

* cited by examiner

*Primary Examiner*—Don Wong
*Assistant Examiner*—Tuyet T. Vo

(57) ABSTRACT

An auxiliary lighting system for a high-intensity discharge lamp. In one embodiment, the auxiliary lighting system has an auxiliary light source, an HID lamp status circuit having an input for connection to a status signal representative of the operational state of a high-intensity discharge lamp wherein the HID lamp status circuit determines whether the status signal meets predetermined signal criteria, a switch circuit having a first state that effects application of a voltage source to the auxiliary light source, and a second state that isolates the voltage source from the auxiliary light source, and a control circuit responsive to the HID lamp status circuit for controlling the switch circuit. The control circuit has a first state when the HID lamp status circuit determines that the status signal meets the predetermined signal criteria and a second state when the HID lamp status circuit determines that the status signal does not meet the predetermined signal criteria. When the control circuit is in the first state, the control circuit outputs a control signal for input into the switch circuit that configures the switch circuit into the first state. When the control circuit is in the second state, the control circuit outputs a control signal for input into the switch circuit that configures the switch circuit into the second state.

25 Claims, 8 Drawing Sheets

AUXILIARY LIGHTING SYSTEM FOR HIGH INTENSITY DISCHARGE LAMP

BACKGROUND OF THE INVENTION

1. Field of the Invention

The present invention generally relates to an electronic auxiliary lighting system for a high intensity discharge lamp.

2. Description of Related Art

Generally, high-intensity discharge ("HID") lamps will extinguish when power to the HID lamp is interrupted. Power interruptions of even a very short duration, e.g. milliseconds, will often extinguish the HID lamp. As is well known in the art, generally, an extinguished HID lamp will not immediately re-ignite upon the restoration of power to the HID lamp because gases within the HID lamp must be cooled before the HID lamp will re-ignite. Furthermore, when the HID lamp is re-ignited, its lumen output is usually only a fraction of the normal lumen output and gradually increases until the HID lamp is at full brightness. Typically, it may take several minutes after restoration of power to the HID lamp before the HID lamp actually attains full brightness. Accordingly, auxiliary lighting control circuitry has been used for automatically lighting an auxiliary light source, such as an incandescent lamp, following a brief power interruption of an HID lamp.

Many standard magnetic HID ballasts provide an auxiliary tap to power an auxiliary light source if the HID lamp extinguishes. The auxiliary light source is controlled by the auxiliary lighting control circuitry that is external to the ballast. Typically, the primary winding of a current transformer is connected in series with the HID lamp. The auxiliary lighting control circuitry senses the ON/OFF condition of the HID lamp by sensing the HID lamp current available at the auxiliary tap. During normal operation of such an auxiliary lighting system, the HID lamp is ON (i.e. energized) and the auxiliary light source is OFF (i.e. de-energized). However, such external auxiliary lighting control circuitry increases the per-unit cost of the HID ballast system. Furthermore, external circuitry may cause additional problems pertaining to packaging and limited available space.

What is needed is an auxiliary lamp system that does not require an auxiliary tap or external circuitry.

SUMMARY OF THE INVENTION

The present invention is directed to, in one aspect, an auxiliary lighting system for a HID lamp, comprising an auxiliary light source, a switch circuit for controlling the application of a voltage source to the auxiliary light source, the switch circuit having a first state that effects application of the voltage source to the auxiliary light source, and a second state that isolates the voltage source from the auxiliary light source, and a control circuit having an input for receiving and being responsive to a signal that indicates the operational state of a HID lamp, the control circuit controlling the duration of time in which the switch circuit is configured in the first state and in the second state wherein the duration of time depends upon the operational state of the HID lamp.

In a related aspect, the present invention is directed to a method of operating an auxiliary lighting system for use with a HID lamp, comprising the steps of providing an auxiliary lighting system comprising an auxiliary light source, and a switch circuit having a first state for effecting application of a voltage source to the auxiliary light source and a second state for isolating the voltage source from the auxiliary light source, providing a status signal that indicates the state of energization of a HID lamp, and controlling the duration of time in which the switch circuit is configured in the first state and the second state wherein the duration of time depends upon the state of energization of the HID lamp.

In another aspect, the present invention is directed to an auxiliary lighting system for a high-intensity discharge lamp. The auxiliary lighting system has an auxiliary light source, an HID lamp status circuit having an input for connection to a status signal representative of the operational state of a high-intensity discharge lamp wherein the HID lamp status circuit determines whether the status signal meets predetermined signal criteria, a switch circuit for controlling the application of a voltage source to the auxiliary light source wherein the switch circuit has a first state that effects application of the voltage source to the auxiliary light source, and a second state that isolates the voltage source from the auxiliary light source, and a control circuit responsive to the HID lamp status circuit for controlling the switch circuit. The control circuit has a first state when the HID lamp status circuit determines that the status signal meets the predetermined signal criteria and a second state when the HID lamp status circuit determines that the status signal does not meet the predetermined signal criteria. When the control circuit is in the first state, the control circuit outputs a control signal for input into the switch circuit that configures the switch circuit into the first state. When the control circuit is in the second state, the control circuit outputs a control signal for input into the switch circuit that configures the switch circuit into the second state.

In a related aspect, the present invention is directed a ballast system, comprising a high-intensity discharge lamp, power feedback circuitry that provides a status signal that represents the state of energization of the high-intensity discharge lamp, an auxiliary light source, a voltage source for energizing the high-intensity discharge lamp and the auxiliary light source, a HID lamp status circuit having an input for receiving the status signal and determining whether the status signal meets the predetermined signal criteria, a switch circuit for controlling the application of the voltage source to the auxiliary light source wherein the switch circuit has a first state that effects application of the voltage source to the auxiliary light source, and a second state that isolates the voltage source from the auxiliary light source, and a control circuit responsive to the HID lamp status circuit for controlling the switch circuit. The control circuit has a first state when the HID lamp status circuit determines that the status signal meets the predetermined signal criteria and a second state when the HID lamp status circuit determines that the status signal does not meet the predetermined signal criteria. When the control voltage is in the first state, the control circuit outputs a control signal for input into the switch circuit that configures the switch circuit into the first state. When the control circuit is in the second state, the control circuit outputs a control signal for input into the switch circuit that configures the switch circuit into the second state.

In a further aspect, the present invention is directed to a method of operating an auxiliary lighting system for a high-intensity discharge lamp, comprising the steps of providing an auxiliary lighting system comprising an auxiliary light source, a HID lamp status circuit, and a switch circuit for controlling the application of a voltage source to the auxiliary light source, inputting into the HID lamp status circuit a status signal representative of the operational state of a high intensity discharge lamp, determining whether the status signal meets predetermined signal criteria, and controlling the switch circuit to apply a voltage source to the auxiliary light source if the status signal meets the predetermined signal criteria.

In yet a further aspect, the present invention is directed to a method of operating a ballast system comprising the steps of providing a ballast system comprising a high intensity discharge lamp, a voltage source for powering the high-intensity discharge lamp, circuitry for controlling the application of power to the high-intensity discharge lamp and providing a status signal that represents the operational state of the high-intensity discharge lamp, an auxiliary lighting system having an auxiliary light source, an HID lamp status circuit for determining whether the status signal meets predetermined signal criteria, a switch circuit for controlling the application of the voltage source to the auxiliary light source, and a control circuit for controlling the switch circuit. The method further comprises the steps of determining whether the status signal meets the predetermined signal criteria, controlling the switch circuit to apply the voltage source to the auxiliary light source if the status signal meets the predetermined signal criteria, and controlling the switch circuit to isolate the voltage source to the auxiliary light source if the status signal does not meet predetermined signal criteria.

BRIEF DESCRIPTION OF THE DRAWINGS

The features of the invention are believed to be novel and the elements characteristic of the invention are set forth with particularity in the appended claims. The invention itself, both as to organization and method of operation, may best be understood by reference to the detailed description which follows taken in conjunction with the accompanying drawings in which:

DETAILED DESCRIPTION OF THE INVENTION

Figure 1:
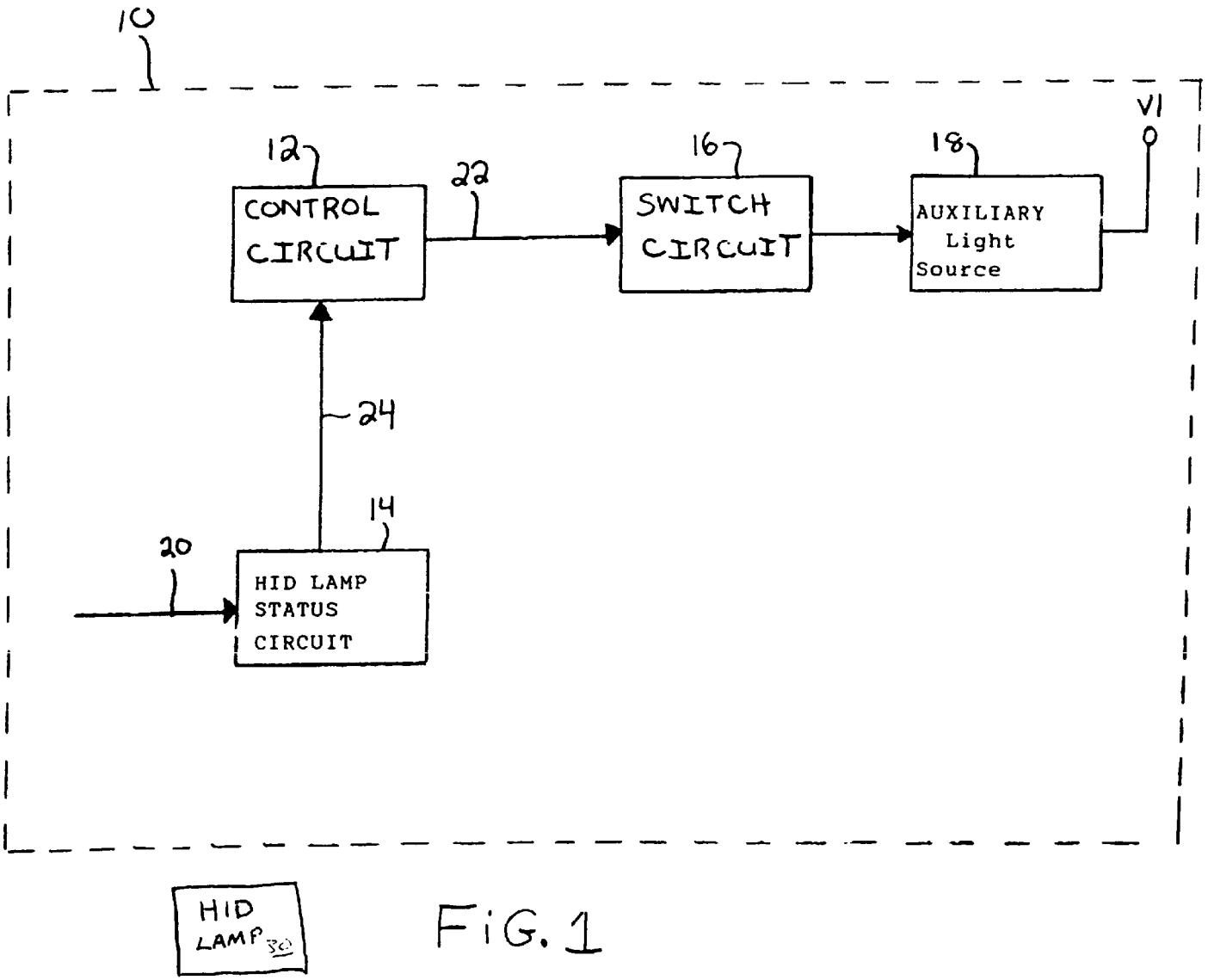
FIG. 1 is a block diagram of the auxiliary lighting system of the present invention.

Referring to FIG. 1, there is shown auxiliary lighting system 10 of the present invention. System 10 generally comprises control circuit 12, HID lamp status circuit 14, switch circuit 16 and auxiliary light source 18. In one embodiment, auxiliary light source 18 is an incandescent lamp having a pair of input leads.

"HID lamp status circuit 14 has an input for connection to status signal 20 produced by the ballast system. Status signal 20 is representative of the operational state or status of a high-intensity discharge ("HID") lamp of the ballast system. Status signal 20 indicates whether a HID lamp 30 is "ON", "OFF" or in the run-up phase. In one embodiment, status signal 20 is an error signal provided by the feedback power circuitry of the ballast system. However, it is to be understood that status signal 20 can be any type of signal that has particular characteristics that can be evaluated by HID lamp status circuit 14. For example, status signal 20 can be a DC signal having a first predetermined amplitude when the HID lamp 30 is "OFF", and a second predetermined amplitude when the HID lamp 30 is "ON". In another example, status signal 20 can be a digital signal that has a logic HIGH level when the HID lamp 30 is energized, and a logic LOW level when the HID lamp 30 is not energized. In a further example, status signal 20 can be in the form of a DC (Direct Current) voltage when the HID lamp 30 is OFF, and an AC (Alternating Current) signal when the HID lamp 30 is ON. HID lamp status circuit 14 determines whether status signal 20 meets predetermined signal criteria. If status signal 20 outputted by the ballast is an error voltage, the predetermined signal criteria is a reference voltage. However, the predetermined signal criteria can have other forms depending upon the form of status signal 20. HID lamp status circuit 14 provides control signal 24 for input into control circuit 12 for controlling the output of control circuit 12. The characteristics of control signal 24 depend upon whether HID lamp status circuit 14 determines that status signal 20 meets the predetermined signal criteria."

"Switch circuit 16 controls the application of voltage source V1 to the auxiliary light source 18. The voltage source V1 is generated by the ballast system within which auxiliary lighting system 10 is located. Typically, the voltage source V1 comprises 480 volts DC. Switch circuit 16 has a first state that effects application of the voltage source V1 to the auxiliary light source 18, and a second state that isolates the voltage source V1 from the auxiliary light source 18."

Control circuit 12 is responsive to signal 24 provided by HID lamp status circuit 14. Control circuit 12 has a first state when HID lamp status circuit 14 determines that status signal 20 meets the predetermined signal criteria and a second state when HID lamp status circuit 14 determines status signal 20 does not meet the predetermined signal criteria. When control circuit 12 is in the first state, control circuit 12 outputs control signal 22 for input into switch circuit 16 that configures switch circuit 16 into the first state. When control circuit 12 is in the second state, control circuit 12 outputs control signal 22 that configures switch circuit 16 into the second state.

In one embodiment, control circuit 12 is configured as a fixed duty-cycle square wave oscillator. In such an embodiment, when control circuit 12 is in the first state, control circuit 12 outputs signal 22 as a square-wave signal having a fixed duty-cycle and a predetermined amplitude. In a preferred embodiment, the frequency of the square-wave signal is above 20 kHz. However, it is to be understood that other frequencies can be used as well. In one embodiment, the duty cycle of the square wave is about 25%. However, control circuit 12 can be configured to output a square wave signal having a duty cycle that is greater or less than 25%. When control circuit 12 is in the second state, control circuit 12 outputs signal 22 as a relatively very low-amplitude DC voltage signal.

It is to be understood that although control circuit 12 is described herein as an oscillator circuit, control circuit 12 can be configured as any other suitable chopper circuit that can provide a regulated voltage to auxiliary light source 18. For example, thyristor choppers and other suitable transistor choppers can be used. Furthermore, other voltage regulation schemes can be used to supply the voltage to auxiliary light source 18, e.g. pulse width modulation, phase control, etc.

Switch circuit 16 is configured in the first state when signal 22 comprises the square wave signal described in the foregoing description. When in the first state, switch circuit 16 effects application of voltage source V1 to auxiliary light source 18. As described in the foregoing description, voltage source V1 is typically about 480 volts DC. Since signal 20 comprises a square-wave signal during this mode of operation, the voltage applied to auxiliary light source 18 is in the form of a square-wave having a peak amplitude of V1, i.e. 480 volts DC. Switch circuit 16 is configured in the second state when signal 22 comprises the relatively very low amplitude DC voltage signal described in the foregoing description. When in the second state, switch circuit 16 isolates voltage source V1 from auxiliary light source 18.

"In one embodiment of the invention, status signal 20 is an error voltage signal produced by the feedback power circuitry (not shown) of a ballast system (not shown) and HID lamp status circuit 14 is configured to evaluate the amplitude of the error signal. In such an embodiment, HID lamp status circuit 14 has an input coupled to error signal 20. When the HID lamp 30 in the ballast system is extinguished, the amplitude of signal 20 is less than a predetermined threshold voltage. When the HID lamp 30 is ignited, the amplitude of error signal 20 increases to an amplitude that is greater than the predetermined threshold voltage. As shown in FIG. 1, HID lamp status circuit 14 provides signal 24 that is inputted into control circuit 12. When the amplitude of error signal 20 is less than a predetermined threshold, HID lamp status circuit 14 provides signal 24 with a first predetermined amplitude that configures control circuit 12 in the first state. As a result, switch circuit 16 is configured in the first state and voltage source V1 is applied to auxiliary light source 18. When the amplitude of error signal 20 is greater than a predetermined threshold voltage, HID lamp status circuit 14 provides signal 24 with a second predetermined amplitude that configures control circuit 12 in the second state. As a result, switch circuit 16 is configured in the second state and voltage source V1 is isolated from auxiliary light source 18."

Figure 2:
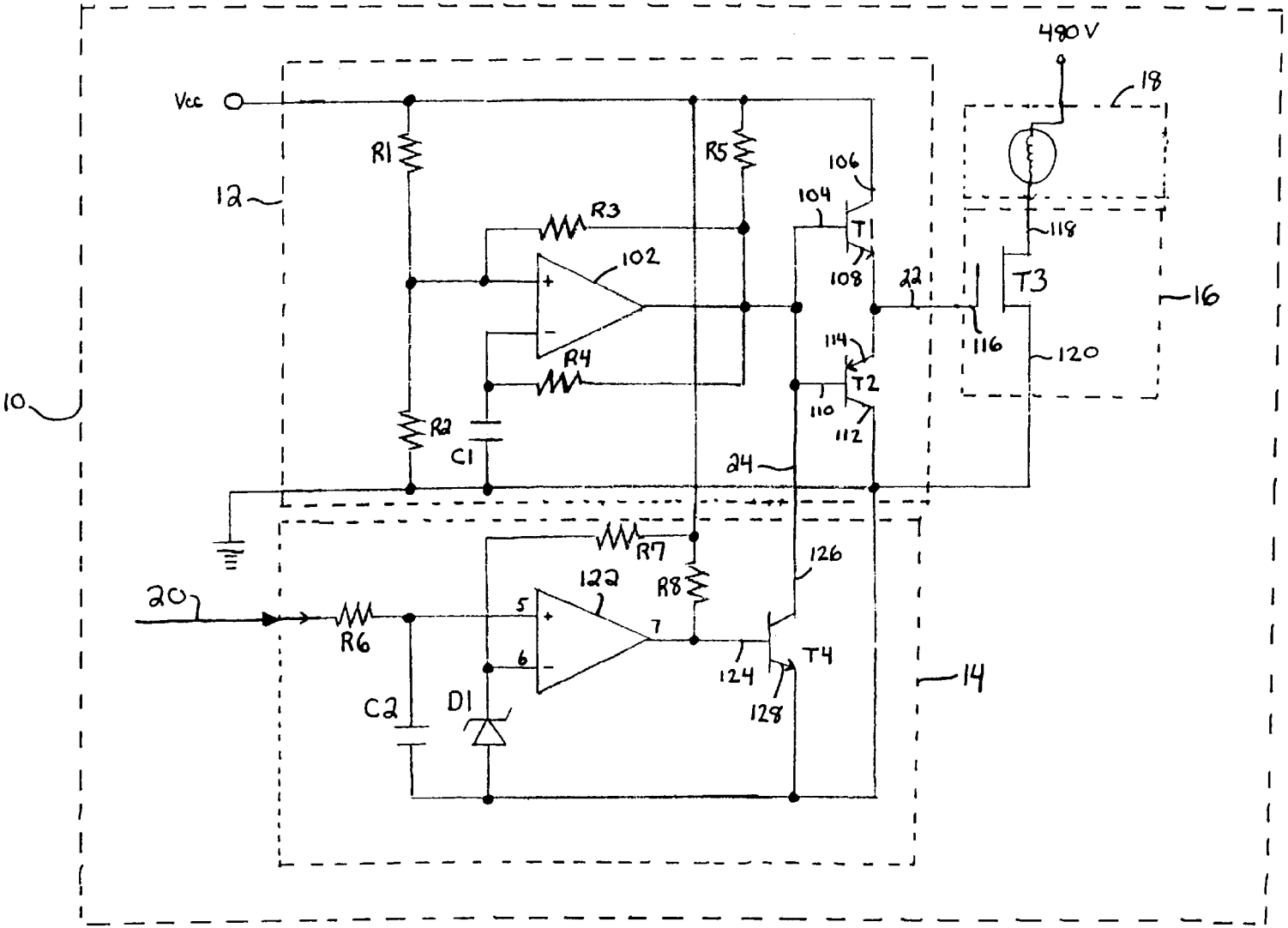
FIG. 2 is a circuit diagram of one embodiment of the auxiliary lighting system of FIG. 1.

Referring to FIG. 2, there is shown a schematic diagram of one embodiment of auxiliary lighting system 10 of the present invention. Control circuit 12 comprises resistor divider network comprising resistors R1 and R2. One end of resistor R1 is connected to positive supply voltage +Vcc and the other end of resistor R1 is connected to one end of resistor R2. The other end of resistor R2 is connected to circuit ground. Control circuit 12 further comprises voltage comparator 102. In a preferred embodiment, comparator 102 is configured as a precision voltage comparator such as the commercially available LM393 voltage comparator manufactured by National Semiconductor. The non-inverting (+) input of comparator 102 is connected to the junction of resistors R1 and R2. Resistors R3 is connected between the non-inverting (+) input of comparator 102 and the output of comparator 102. Resistor R4 is connected between the inverting (−) input of comparator 102 and the output of comparator 102. Resistor R5 is connected between the output of comparator 102 and +Vcc. Capacitor C1 is connected between the inverting (−) input of comparator 102 and circuit ground and functions as a decoupling capacitor.

In one embodiment, resistors R1, R2, R3, R4 and R5 have resistance values of about 100 KΩ, 5.6Ω, 220 KΩ, 100 KΩ, and 22 KΩ, respectively. In one embodiment, capacitor C1 has a capacitance of about 0.001 uF. Control circuit 12 further includes transistors T1 and T2. Transistor T1 is an NPN transistor and transistor T2 is a PNP transistor. Transistor T1 comprises base 104, collector 106 and emitter 108. Similarly, transistor T2 comprises base 110, collector 112 and emitter 114. Bases 104 and 110 of transistors T1 and T2, respectively, are connected to the output of comparator 102. Collector 106 of transistor T1 is connected to +Vcc. Emitter 108 of transistor T1 is connected to emitter 114 of transistor T2. Collector 112 of transistor T2 is connected to circuit ground. The junction of emitters 108 and 114 provides output signal 22. In one embodiment, transistor T1 is a 2N4401 transistor and transistor T2 is a 2N4403 transistor.

Referring to FIG. 2, switch circuit 16 comprises power transistor T3. In one embodiment, transistor T3 is a FET power transistor having gate 116 that is connected to output signal 22, drain 118 that is connected to one end of light source 18, and source 120 that is connected to circuit ground. In one embodiment, transistor T3 is a commercially available 7N60 power FET.

"Referring to FIG. 2, in one embodiment, HID lamp status circuit 14 comprises an input circuit that comprises resistor R6 and capacitor C2. Resistor R6 has one end thereof connected to error signal 20 and another end connected to one of capacitor C2. The other end of capacitor C2 is connected to circuit ground. HID lamp status circuit 14 further includes comparator 122. In one embodiment, comparator 122 is configured as the LM393 precision voltage comparator described in the foregoing description. HID lamp status circuit 14 further includes Zener diode D1 that is connected between the inverting (−) input of comparator 122 and circuit ground. Zener diode D1 provides a reference voltage. In one embodiment, the Zener voltage of Zener diode D1 is about 5.6. volts. Resistor R7 is connected between the inverting (−) input of comparator 122 and +Vcc. Resistor R8 is connected between the output of comparator 122 and +Vcc. In one embodiment, resistors R7 and R8 have resistances of about 22 KΩ. Resistors R7 and R8 form a voltage divider network. HID lamp status circuit 14 further includes transistor T4. Transistor T4 includes base 124 connected to the output of comparator 122, collector 126 that is connected to the bases 104 and 110 of transistors T1 and T2, respectively, and emitter 128 that is connected to circuit ground. Signal 24 is provided by collector 126. In one embodiment, transistor T4 is a 2N4401 transistor."

"Referring to FIG. 2, HID lamp status circuit 14 provides signal 24 that is inputted into control circuit 12 and connected to the bases 104 and 110 of transistors T1 and T2, respectively. When the HID lamp 30 in the ballast system is extinguished, the amplitude of signal 20 is less than the predetermined threshold voltage set by Zener diode D1. In response, comparator 122 outputs a low-amplitude DC signal that turns "OFF" transistor T4 thereby providing signal 24 with a first predetermined amplitude that results in transistors T1 and T2 being turned "ON". As a result, control circuit 12 is configured in the first state and outputs control signal 22 as a square-wave signal. In response, transistor T3 of switch circuit is 16 is turned "ON" and thus, switch circuit 16 is configured in the first state and voltage source V1 is applied to auxiliary light source 18. When the amplitude of error signal 20 is greater than a predetermined threshold voltage, HID lamp status circuit 14 outputs a relatively higher amplitude signal that turns "ON" transistor T4 thereby providing signal 24 with a voltage level that causes transistors T1 and T2 to be turned "OFF". As a result, control circuit 12 is configured in the second state and outputs signal 22 with an amplitude that turns "OFF" transistor T3 of switch circuit 16 thereby configuring switch circuit 16 in the second state so as to isolate voltage source V1 from auxiliary light source 18."

"Although the foregoing description is in terms of signal 20 comprising an error signal produced by the feedback power circuitry of the ballast, it is to be understood that status signal 20 can be configured to have other suitable forms or characteristics that can indicate the operational state or status of the HID lamp 30, and that HID lamp status circuit 14 can be appropriately modified to evaluate such a status signal."

Figure 3A:
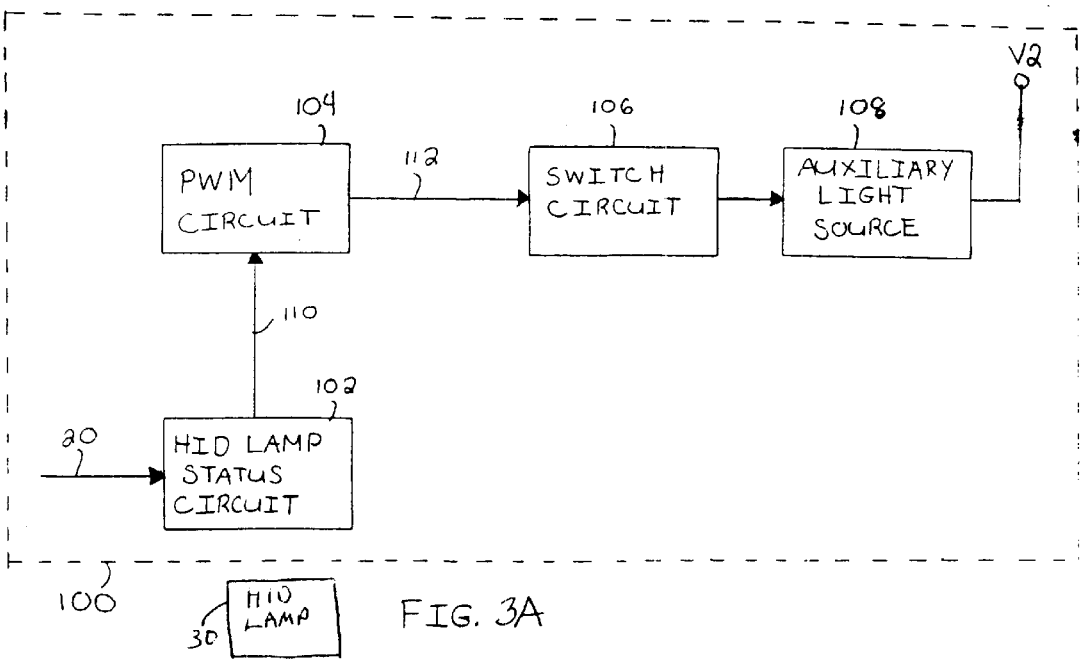
FIGS. 3A–8 are block diagrams of other embodiments of the auxiliary lighting system of the present invention.

Referring to FIG. 3A, there is shown another embodiment of the auxiliary lighting system of the present invention wherein control circuit 12 is configured as a pulse width modulator ("PWM") circuit. System 100 generally comprises HID lamp status circuit 102, PWM circuit 104, switch circuit 106 and auxiliary light source 108. HID lamp status circuit 102 functions in the same manner as HID lamp status circuit 14 described in the foregoing description. In one embodiment, switch circuit 106 and auxiliary light source 108 have the same configurations as switch circuit 16 and auxiliary light source 18, respectively, described in the foregoing description. Circuit 102 receives status signal 20, which was described in the foregoing description, and outputs signal 110 that enables or disables PWM circuit 104. When circuit 102 determines that status signal 20 meets predetermined signal characteristics, signal 110 enables PWM circuit 104 to output control signal 112 to switch circuit 106. Control signal 112 comprises a pulse train wherein each pulse has a width. In response, switch circuit 106 is configured to effect application of voltage source V2 to auxiliary light source 108. When circuit 102 determines that status signal 20 does not meet predetermined signal characteristics, signal 110 disables PWM circuit 104 so that that signal 112 configures switch circuit 106 to isolate voltage source V2 from auxiliary light source 108. In a preferred embodiment, voltage source V2 is a fixed or constant DC rail voltage such as 480 volts or 240 volts. In a preferred embodiment, PWM circuit 104 is configured as a constant duty cycle PWM circuit for use with a regulated DC voltage source or a single input rectified AC voltage.

Figure 3B:
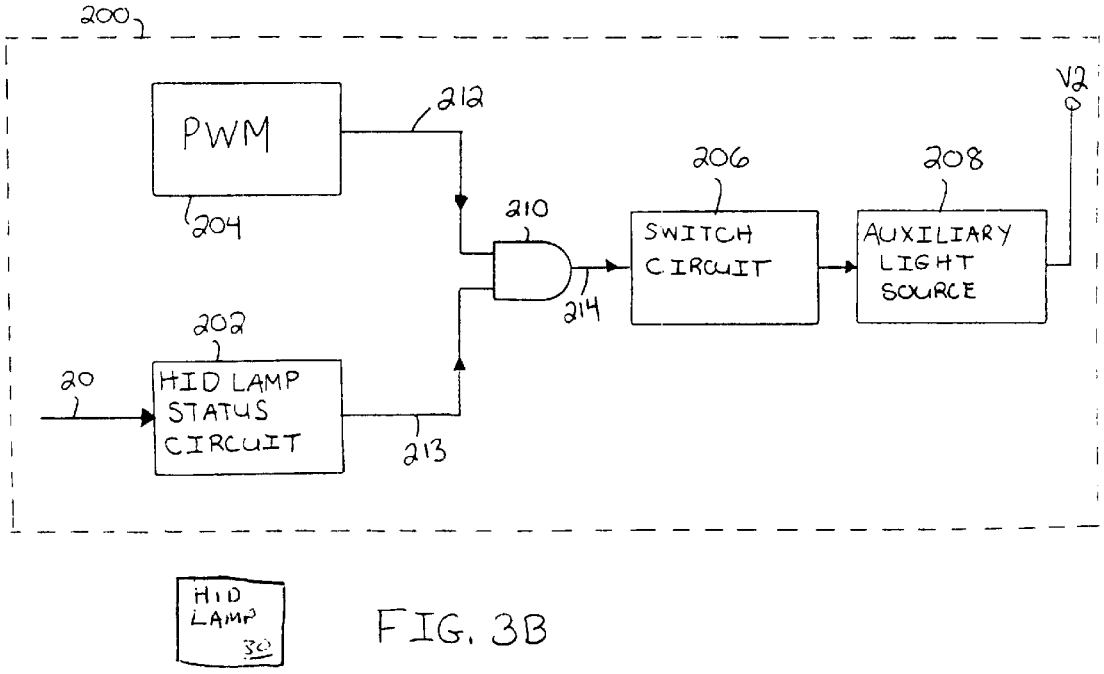

Referring to FIG. 3B, there is shown another embodiment of the auxiliary lighting system of the present invention. System 200 generally comprises HID lamp status circuit 202, PWM circuit 204, switch circuit 206, and auxiliary light source 208. PWM circuit 204, switch circuit 206 and auxiliary light source 206 are generally the same in configuration and function as PWM circuit 104, switch circuit 106 and auxiliary light source, respectively, described in the foregoing description. System 200 further includes AND gate 210, the purpose of which is discussed in the ensuing description. PWM circuit 204 outputs constant duty cycle control signal 212 that is inputted into AND gate 212. HID lamp status circuit 202 receives status signal 20 and determines whether signal 20 meets predetermined signal criteria. If signal 20 meets the predetermined signal criteria, circuit 202 outputs enabling signal 213 for input into AND gate 210 thereby causing AND gate 210 to output signal 214 that conforms to signal 212. Signal 214 configures switch circuit 206 so as to effect application of voltage source V2 to auxiliary light source 208. If signal 20 meets the predetermined signal criteria, circuit 202 outputs signal 213 with disabling characteristics (e.g. logic "LOW" level) thereby preventing signal 212 from being recreated at the output of AND gate 210. As a result, AND gate 210 outputs signal 214 with characteristics that configure switch circuit 206 so as to isolate voltage source V2 from to auxiliary light source 208.

"The embodiments described in FIGS. 3A and 3B can be configured without the HID lamp status circuits. In a such a configuration, status signal 20 has a first logic level when the HID lamp 30 is extinguished, a second logic level when the HID lamp 30 is "ON" and is inputted directly into PWM circuit 104 so as to either disable or enable PWM circuit 104, depending upon the logic level of signal 20. Similarly, signal 20 can be used to drive AND gate 210 directly."

Figure 4:
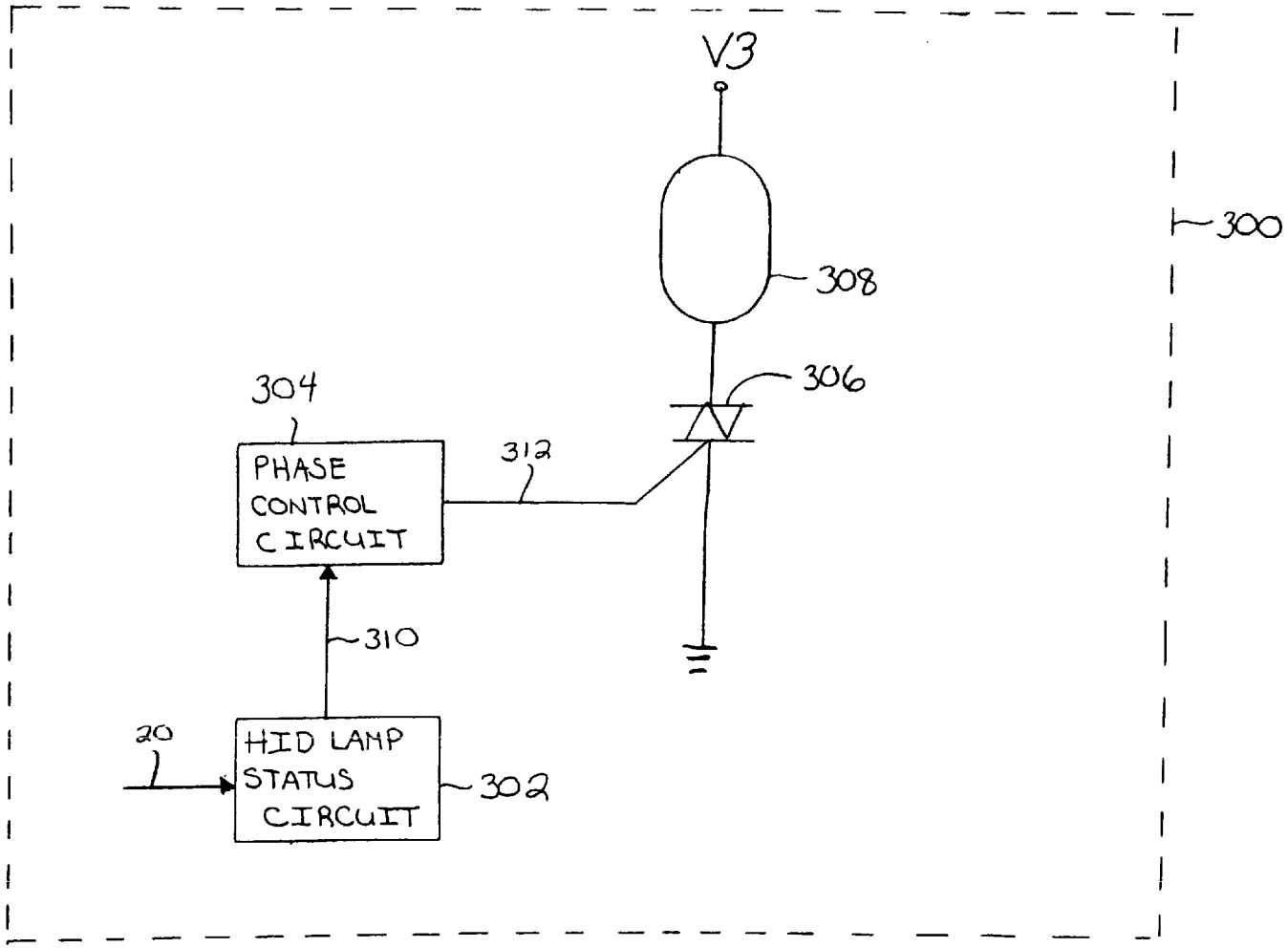

"Referring to FIG. 4, there is shown another embodiment of the auxiliary lighting system of the present invention. System 300 is configured for use with a single input AC voltage source V3. The AC voltage can be either half-wave or full-wave rectified depending on the magnitude of the AC voltage. System 300 generally comprises HID lamp status circuit 302, phase control circuit 304, triac 306 and auxiliary light source 308. Triac 306 functions as a switch that, when "ON", causes AC voltage source to be applied to light source 308 and when "OFF", causes the AC voltage source V3 to be isolated from light source 308. HID lamp status circuit 302 receives status signal 20 and has generally the same configuration as the HID lamp status circuits described in the previous embodiments. Circuit 302 outputs signal 310 that either enables or disables phase control circuit 304. If circuit 302 determines that status signal 20 meets predetermined signal criteria (i.e. the HID lamp is "ON"), signal 310 enables phase control circuit 304 to output signal 312 to the gate of triac 306 so as to turn "ON" triac 306. Triac 306, when "ON", is on only for a constant portion of each AC half cycle resulting in a proportional output. If circuit 302 determines that status signal 20 does not meet predetermined signal criteria (i.e. the HID lamp 30 is extinguished), signal 310 enables phase control circuit 304 to output signal 312 to the gate of triac 306 so as to turn "OFF" triac 306 thereby isolating light source 308 from voltage source V3. Thus, system 300 provides constant phase control for a single input voltage."

"It is to be understood that the embodiment described in FIG. 4 can be configured without the HID lamp status circuit. In a such a configuration, status signal 20 has a first logic level when the HID lamp 30 is extinguished, a second logic level when the HID lamp 30 is "ON" and is inputted directly into phase control circuit 304 and either disables or enables phase control circuit 304, depending upon the logic level of signal 20."

Figure 5:
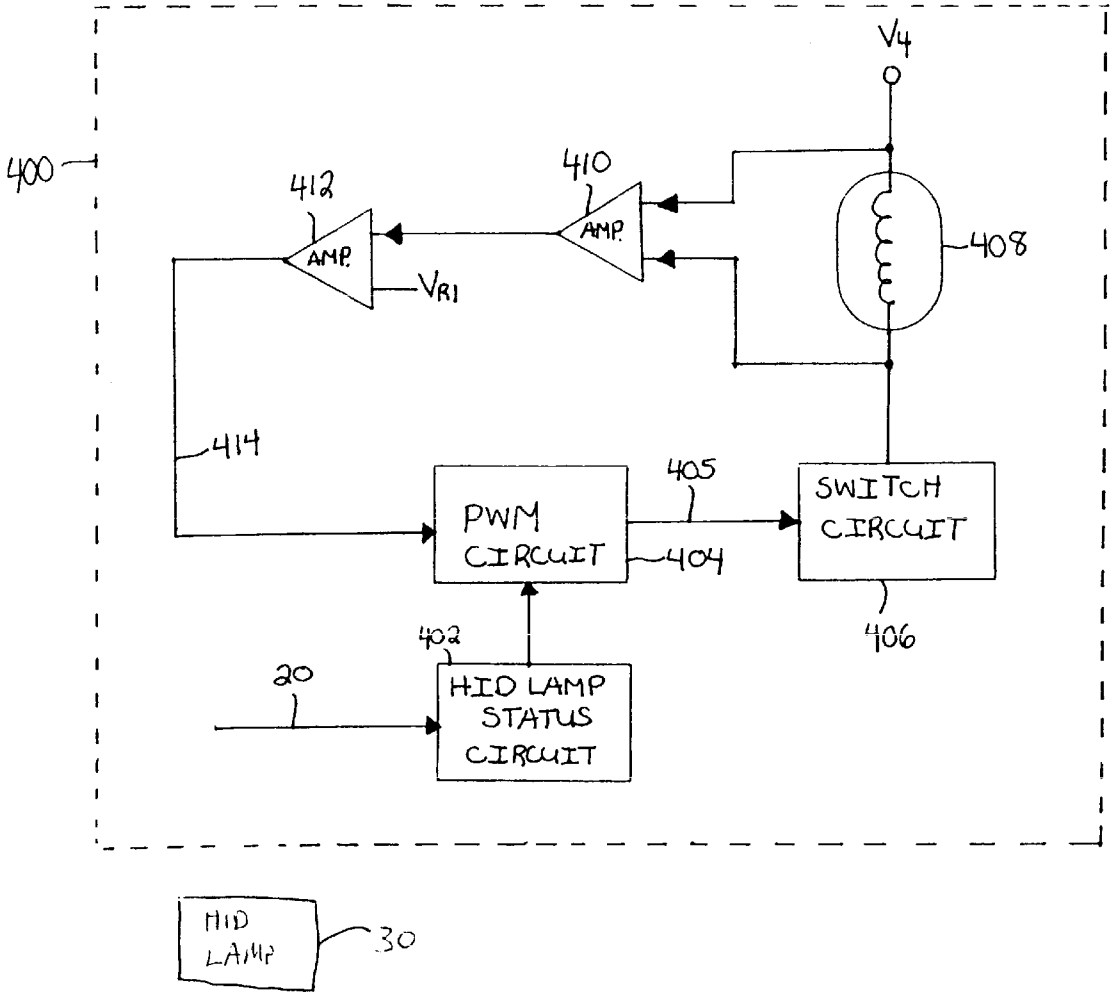

"Referring to FIG. 5, there is shown another embodiment of the auxiliary lighting system of the present invention. Auxiliary lighting system 400 is configured to operate with a variable DC voltage or a rectified input voltage source V4. System 400 generally comprises HID lamp status circuit 402, pulse width modulator ("PWM") circuit 404, switch circuit 406, and auxiliary light source 408 which have generally the same configuration and function in the same manner as HID lamp status circuit 102, pulse width modulator circuit 104, switch circuit 106, and auxiliary light source 108, respectively, shown in FIG. 3A. PWM circuit 404 outputs signal 405 for input into switch circuit 406. System 400 further includes amplifiers 410 and 412. Amplifier 410 is configured as a differential amplifier and amplifies the voltage drop across light source 408. The output of amplifier 410 is coupled to an input of amplifier 412. Reference voltage $V_{R1}$ is coupled another input of amplifier 412. Amplifier 412 is configured as an error amplifier and outputs error signal 414. Error signal 414 is inputted into PWM circuit 404 wherein the magnitude of error signal 414 varies the pulse width of the pulses of signal 405 and thus, the duty cycle of signal 405. Thus, the voltage across light source 408 is monitored and is used to vary the pulse width of signal 405 in order to maintain the voltage applied to light source 408 at a constant level. System 400 allows the output voltage across light source 408 to be accurately controlled regardless of the fluctuations in voltage source V4. System 400 is most suitable if a constant DC or rectified AC source are not available."

In an alternate embodiment, system 400 is configured without HID lamp status circuit 402. In such a configuration, status signal 20 is inputted directly into PWM circuit 404 and has a first level or magnitude that enables PWM circuit 404 to output signal 405 that will turn "ON" switch circuit 406 and a second level or magnitude that disables PWM circuit 404 so as to turn "OFF" switch circuit 406. In a further embodiment, system 400 utilizes and an AND gate (not shown) that receives status signal 20 and signal 405 and wherein the output of the AND gate drives switch circuit 406.

Figure 6:
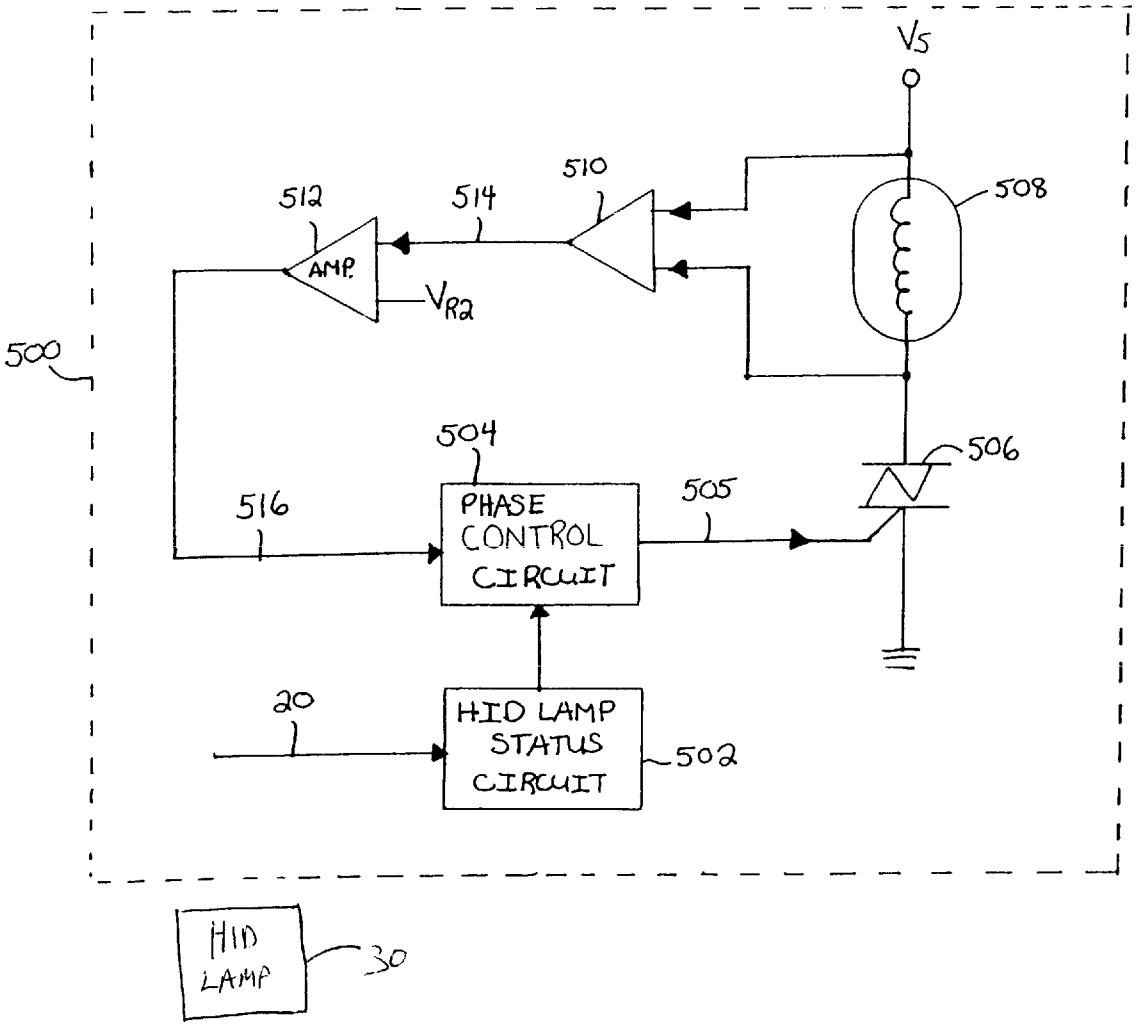

"Referring to FIG. 6, there is shown another embodiment of the auxiliary lighting system of the present invention. Auxiliary lighting system 500 is configured for use with a single input AC voltage source V5. The AC voltage can be either half-wave or full-wave rectified depending on the magnitude of the AC voltage. Auxiliary lighting system 500 generally comprises the system shown in FIG. 4 with the addition of feedback components. Thus, system 500 generally comprises HID lamp status circuit 502, phase control circuit 504, triac 506 and auxiliary light source 508 which have generally the same configuration and function in the same manner as HID lamp status circuit 302, phase control circuit 304, triac 306, and auxiliary light source 308, respectively, shown in FIG. 4. Phase control circuit 504 outputs signal 505 for input into the gate of triac 506. System 500 further includes rectifier circuit 510 and amplifier 512. Rectifier circuit 510 is configured as an active rectifier circuit and converts the AC voltage drop across light source 508 into a DC voltage. Rectifier circuit 510 outputs the DC voltage signal 514 for input into amplifier 512. Reference voltage $V_{R2}$ is coupled to another input of amplifier 512. Amplifier 512 is configured as an error amplifier and outputs error signal 516 which represents the difference between the magnitude of signal 514 and reference voltage VR2. Error signal 516 is inputted into phase control circuit 504. The magnitude of error signal 516 varies the phase of signal 505. Thus, the voltage across light source 508 is monitored and is used to control triac 506 in order to maintain the voltage applied to light source 508 at a constant level. System 500 allows the output voltage across light source 508 to be accurately controlled regardless of the fluctuations in voltage source V5. System 500 is most suitable if a constant DC or rectified AC source are not available. In an alternate embodiment, system 500 is configured without HID lamp status circuit 502. In such a configuration, status signal 20 is inputted directly into phase control circuit 504 in a manner similar to that described in the foregoing description pertaining to the embodiment shown in FIG. 4."

Figure 7:
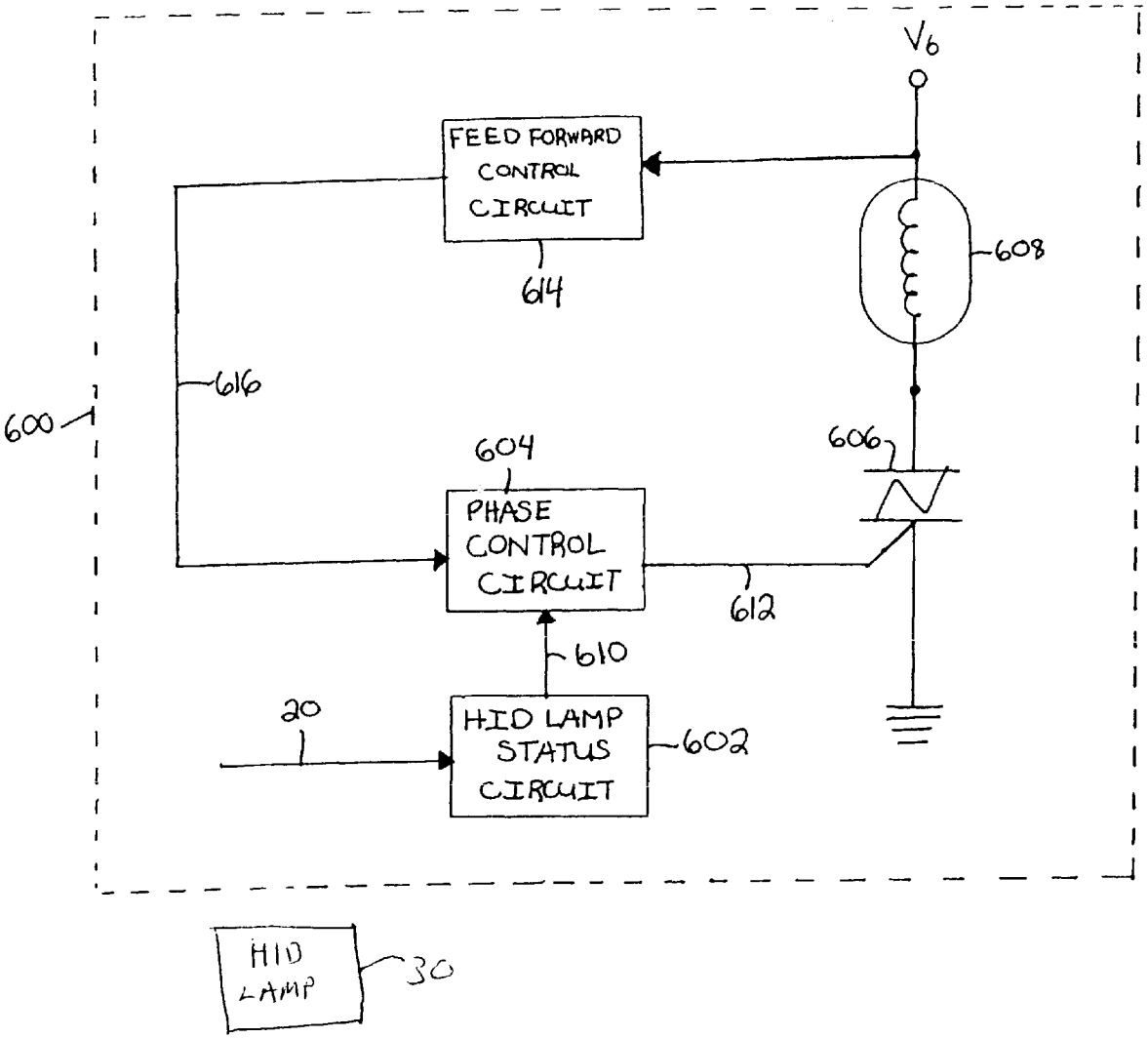

"Referring to FIG. 7, there is shown a further embodiment of the auxiliary lighting system of the present invention. System 600 is configured for use with a variable input AC voltage source V6. The AC voltage can be either half-wave or full-wave rectified depending on the magnitude of the AC voltage. System 600 generally comprises HID lamp status circuit 602, phase control circuit 604, triac 606 and auxiliary light source 608. Triac 606 functions as a switch that, when "ON", causes AC voltage source V6 to be applied to light source 608 and when "OFF", causes the AC voltage source V6 to be isolated from light source 608. HID lamp status circuit 602 receives status signal 20 and has generally the same configuration as the HID lamp status circuits described in the previous embodiments. Circuit 602 outputs signal 610 that either enables or disables phase control circuit 604. If circuit 602 determines that status signal 20 meets predetermined signal criteria (i.e. the HID lamp 30 is "ON"), signal 610 enables phase control circuit 604 to output signal 612 to the gate of triac 606 so as to turn "ON" triac 606. Triac 606, when "ON", is on only for a constant portion of each AC half cycle resulting in a proportional output. If circuit 602 determines that status signal 20 does not meet predetermined signal criteria (i.e. the HID lamp 30 is extinguished), signal 610 enables phase control circuit 604 to output signal 612 to the gate of triac 606 so as to turn "OFF" triac 606 thereby isolating light source 608 from voltage source V6. System 600 further includes feed forward control circuit 614 that is connected between the voltage applied to light source 608 and phase control circuit 604. Feed forward control circuit 614 outputs control signal 616 that controls phase control circuit 604 so as to vary the phase of signal 612. As a result, triac 606 responds to the varying phase of signal 612 thereby varying the AC voltage applied to light source 608. Feed forward control circuit 614 compensates for known changes in the input voltage source V6. It is to be understood that the embodiment described in FIG. 7 can be configured without the HID lamp status circuit as described in the foregoing description. In a such a configuration, status signal 20 has a first logic level when the HID lamp 30 is extinguished, a second logic level when the HID lamp 30 is "ON" and is inputted directly into phase control circuit 604 so as to either disable or enable phase control circuit 604, depending upon the logic level of signal 20."

Figure 8:
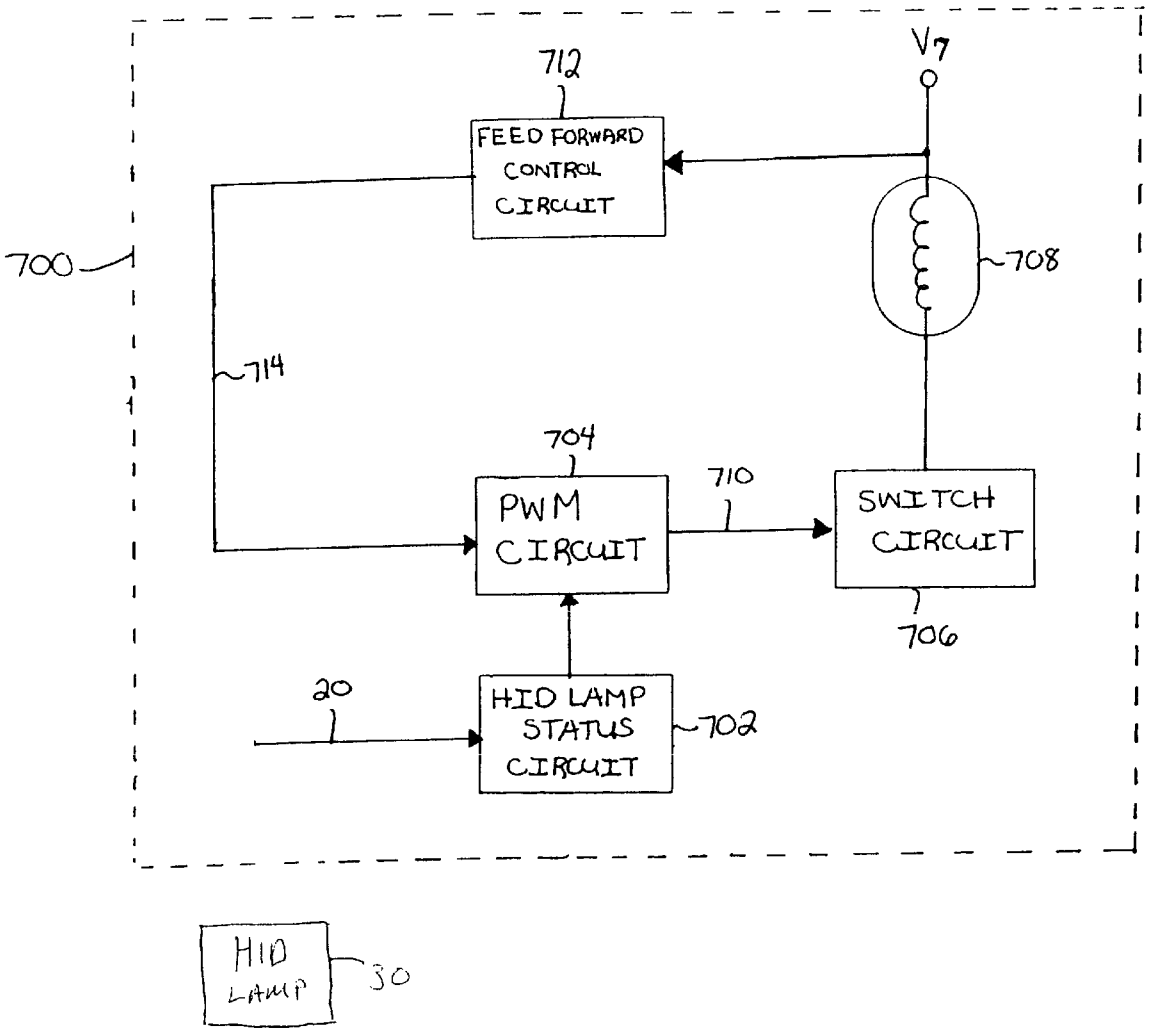

"Referring to FIG. 8, there is shown another embodiment of the auxiliary lighting system of the present invention. Auxiliary lighting system 700 is suitable for use with a variable DC voltage source or a rectified AC voltage source V7. Auxiliary lighting system 700 generally comprises HID lamp status circuit 702, pulse width modulation ("PWM") circuit 704, switch circuit 706, and auxiliary light source 708 which have the same configuration and function in the same manner as HID lamp status circuit 202, pulse width modulation ("PWM") circuit 204, switch circuit 206 and auxiliary light source 208, respectively, of system 200 that was described in the foregoing description. PWM circuit 704 outputs signal 710 that controls switch circuit 706 so as to either effect application of voltage source V7 to light source 708 or isolate light source 708 from voltage source V8. System 700 further includes feed forward control circuit 712 that is connected between the voltage applied to light source 708 and PWM circuit 704. Feed forward control circuit 712 outputs control signal 714 that controls PWM circuit 704 so as to vary the pulse width of signal 710. As a result, switch circuit 706 is affected by the varying pulse width of signal 710 and therefore varies the voltage applied to light source 708. Feed forward control circuit 712 compensates for known changes in the input voltage source V7. System 700 is suitable for situations wherein the variations in voltage source V7 are well defined. The pulse width of signal 710 is adjusted as a function of voltage source V7 in order to maintain the voltage that is applied to light source 708 at a constant level. For example, if voltage source V7 comprises a DC voltage source, system 700 operates in such a manner that the pulse width of signal 710 is inversely proportional to the supply voltage thereby providing a substantially constant output voltage."

"It is to be understood that the embodiment described in FIG. 8 can be configured without the HID lamp status circuit as described in the foregoing description. In a such a configuration, status signal 20 has a first logic level when the HID lamp 30 is extinguished, a second logic level when the HID lamp 30 is "ON" and is inputted directly into PWM circuit 704 so as to either disable or enable phase control circuit 704, depending upon the logic level of signal 20. In another embodiment, system 700 is configured to utilize an AND gate that receives status signal 20 and signal 710 in a manner similar to the configuration shown in FIG. 3B."

The auxiliary lighting system of the present invention can be inexpensively integrated with conventional electronic HID ballast systems thereby eliminating the problems associated with external auxiliary lighting control circuitry.

Furthermore, the auxiliary lighting system of the present invention can be inexpensively manufactured with commercially available components.

The principals, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations in changes may be made by those skilled in the art without departing from the spirit of the invention. Accordingly, the foregoing detailed description should be considered exemplary in nature and not limited to the scope and spirit of the invention as set forth in the attached claims.

Thus, having described the invention, what is claimed is:

1. An auxiliary lighting system for a HID lamp, comprising:

an auxiliary light source;

a switch circuit for controlling the application of a voltage source to the auxiliary light source, the switch circuit having a first state that effects application of the voltage source to the auxiliary light source, and a second state that isolates the voltage source from the auxiliary light source;

a control circuit having an input for receiving and being responsive to a signal that indicates the operational state of a HID lamp, the control circuit controlling the duration of time in which the switch circuit is configured in the first state and in the second state wherein the duration of time depends upon the operational state of the HID lamp, the control circuit including a pulse width modulation circuit that output a control signal comprising a pulse train that controls the switch circuit; and a feedback circuit for comparing the voltage applied to the auxiliary light source to a reference voltage and outputting an error signal having a magnitude that is based upon the difference between the voltage applied to the auxiliary light source and the reference voltage, the pulse width modulation circuit being responsive to the error signal such that the pulse width of the pulses of the pulse train is varied in accordance with the magnitude of the error signal.

2. An auxiliary lighting system for a HID lamp, comprising:

an auxiliary light source;

a switch circuit for controlling the application of a voltage source to the auxiliary light source, the switch circuit having a first state that effects application of the voltage source to the auxiliary light source, and a second state that isolates the voltage source from the auxiliary light source;

a control circuit having an input for receiving and being responsive to a signal that indicates the operational state of a HID lamp, the control circuit controlling the duration of time in which the switch circuit is configured in the first state and in the second state wherein the duration of time depends upon the operational state of the HID lamp, the control circuit including comprises a phase control circuit for outputting a control signal to the switch circuit; and a feedback circuit for comparing the voltage applied to the auxiliary light source to a reference voltage and outputting an error signal having a magnitude that is based upon the difference between the voltage applied to the auxiliary light source and the reference voltage, the phase control circuit being responsive to the error signal such that the phase of the control signal is varied in accordance with the magnitude of the error signal.

3. The auxiliary lighting system according to claim 2 wherein voltage source is an AC voltage source and the feedback circuit further comprises a rectifier circuit for converting the AC voltage applied to the auxiliary light source to a DC voltage, and an error amplifier for comparing the DC voltage to a reference voltage and outputting an error signal having a magnitude for input into the phase control circuit wherein the phase of the control signal is varied according to the magnitude of the error signal.

4. A method of operating an auxiliary lighting system for use with a HID lamp, comprising the steps of:

providing an auxiliary lighting system comprising an auxiliary light source, a switch circuit having a first state for effecting application of a voltage source to the auxiliary light source and a second state for isolating the voltage source from the auxiliary light source, and a control circuit that is responsive to the status signal, the control circuit outputting a control signal to control the switch circuit so as to configure the switch circuit in either the first state or the second state depending upon the state of energization of the HID lamp, the control circuit comprising a phase control circuit;

providing a status signal that indicates the state of energization of a HID lamp;

controlling the duration of time in which the switch circuit is configured in the first state and the second state wherein the duration of time depends upon the state of energization of the HID lamp;

determining the voltage applied to the auxiliary light source;

comparing the determined voltage to a predetermined reference voltage to produce an error signal having a magnitude; and adjusting the phase of the control signal in accordance with the magnitude of the error signal.

5. The method according to claim 4 wherein the voltage source is an AC voltage and the determining step comprises the step of converting the AC voltage applied to the auxiliary light source to DC voltage, the DC voltage defining the determined voltage.

6. An auxiliary lighting system for a HID lamp, comprising:

an auxiliary light source;

a switch circuit for controlling the application of a voltage source to the auxiliary light source, the switch circuit having a first state that effects application of the voltage source to the auxiliary light source, and a second state that isolates the voltage source from the auxiliary light source; and a control circuit having an input for receiving and being responsive to a signal that indicates the operational state of a HID lamp, the control circuit controlling the duration of time in which the switch circuit is configured in the first state and in the second state wherein the duration of time depends upon the operational state of the HID lamp.

7. The auxiliary lighting system according to claim 6 further comprising an HID lamp status circuit having an input for connection to an HID lamp status signal that represents the operational state of a high-intensity discharge lamp, the HID lamp status circuit determining whether the HID lamp status signal meets predetermined signal criteria and outputting the signal to which the control circuit is responsive, the control circuit controlling the duration of time in which the switch circuit is configured in the first state and in the second state wherein said duration of time depends upon whether the HID lamp status signal meets the predetermined signal criteria.

8. The auxiliary lighting system according to claim 7 wherein the predetermined signal criteria comprises a predetermined threshold voltage and the HID lamp status circuit compares the magnitude of the HID lamp status signal to the predetermined threshold voltage wherein HID lamp status signal meets the predetermined signal criteria when the magnitude of the HID lamp status signal is less than the predetermined threshold voltage and wherein the HID lamp status signal does not meet the predetermined signal criteria when the magnitude of the HID lamp status signal is greater than the predetermined threshold voltage, the duration of time in which the control circuit configures the switch circuit into first state being generally the same as the duration of time in which the magnitude of the HID lamp status signal is less than the predetermined threshold voltage, the duration of time in which the control circuit configures the switch circuit into the second state being generally the same as the duration of time in which the magnitude of the HID lamp status signal is greater than the predetermined threshold voltage.

9. The auxiliary lighting system according to claim 6 wherein the control circuit comprises a chopper circuit.

10. The auxiliary lighting system according to claim 9 wherein the chopper circuit comprises a square-wave oscillator that outputs a square wave signal that controls the switch circuit.

11. The auxiliary lighting system according to claim 9 wherein the chopper circuit comprises a pulse width modulation circuit that outputs a control signal comprising a pulse train that controls the switch circuit.

12. The auxiliary lighting system according to claim 11 further comprising a feedback circuit for comparing the voltage applied to the auxiliary light source to a reference voltage and outputting an error signal having a magnitude that is based upon the difference between the voltage applied to the auxiliary light source and the reference voltage, the pulse width modulation circuit being responsive to the error signal such that the pulse width of the pulses of the pulse train is varied in accordance with the magnitude of the error signal.

13. The auxiliary lighting system according to claim 11 further comprising a feed forward control circuit for monitoring the voltage source and outputting a signal for input into the pulse width modulation circuit for varying the pulse width of the pulses of the pulse train in accordance with the variations in the voltage supply.

14. The auxiliary lighting system according to claim 9 wherein the voltage source is an AC voltage source and the control circuit comprises a phase control circuit for outputting a control signal to the switch circuit.

15. The auxiliary lighting system according to claim 14 further comprising a feedback circuit for comparing the voltage applied to the auxiliary light source to a reference voltage and outputting an error signal having a magnitude that is based upon the difference between the voltage applied to the auxiliary light source and the reference voltage, the phase control circuit being responsive to the error signal such that the phase of the control signal is varied in accordance with the magnitude of the error signal.

16. The auxiliary lighting system according to claim 15 wherein voltage source is an AC voltage source and the feedback circuit further comprises a rectifier circuit for converting the AC voltage applied to the auxiliary light source to a DC voltage, and an error amplifier for comparing the DC voltage to a reference voltage and outputting an error signal having a magnitude for input into the phase control circuit wherein the phase of the control signal is varied according to the magnitude of the error signal.

17. The auxiliary lighting system according to claim 14 further comprising a feed forward control circuit for monitoring the voltage source and outputting a signal for input into the phase control circuit for varying the phase of the control signal outputted by the phase control circuit in response to variations in the voltage supply.

18. A method of operating an auxiliary lighting system for use with a HID lamp, comprising the steps of:

providing an auxiliary lighting system comprising an auxiliary light source, and a switch circuit having a first state for effecting application of a voltage source to the auxiliary light source and a second state for isolating the voltage source from the auxiliary light source;

providing a status signal that indicates the state of energization of a HID lamp; and controlling the duration of time in which the switch circuit is configured in the first state and the second state wherein the duration of time depends upon the state of energization of the HID lamp.

19. The method according to claim 18 wherein the auxiliary lighting system further comprises a control circuit that is responsive to the status signal, the control circuit outputting a control signal to control the switch circuit so as to configure the switch circuit in either the first state or the second state depending upon the state of energization of the HID lamp, the control circuit comprising a pulse width modulator circuit and wherein the control signal comprises a pulse train having a plurality of pulses, each pulse having a pulse width, the method further comprising the steps of:

determining the voltage applied to the auxiliary light source;

comparing the determined voltage to a predetermined reference voltage to produce an error signal having a magnitude; and adjusting the width of the pulses of the pulse train in accordance with the magnitude of the error signal.

20. The method according to claim 18 wherein the auxiliary lighting system further comprises a control circuit that is responsive to the status signal, the control circuit outputting a control signal to control the switch circuit so as to configure the switch circuit in either the first state or the second state depending upon the state of energization of the HID lamp, the control circuit comprising a pulse width modulator circuit and wherein the control signal comprises a pulse train having a plurality of pulses, each pulse having a pulse width, the method further comprising the steps of:

monitoring variations in the voltage supply; and adjusting the width of the pulses of the pulse train in accordance with the variations in the voltage supply.

21. The method according to claim 18 wherein the auxiliary lighting system further comprises an HID lamp status circuit having an input for connection to an electrical signal that represents the state of energization of the HID lamp and determining whether the electrical signal meets predetermined signal criteria and outputting a signal that defines the status signal, the controlling step comprising the step of configuring the switch circuit in the first state for a duration of time that is generally the same as the duration of time in which the status signal meets the predetermined signal criteria.

22. The method according to claim 21 wherein the controlling step further comprises of configuring the switch circuit in the second state for a duration of time that is generally the same as the duration of time in which the status signal does not meet the predetermined signal criteria.

23. The method according to claim 22 wherein the auxiliary lighting system further comprises a control circuit that is responsive to the status signal, the control circuit outputting a control signal to control the switch circuit so as to configure the switch circuit in either the first state or the second state depending upon the state of energization of the HID lamp, the control circuit comprising a phase control circuit, the method further comprising the steps of:

determining the voltage applied to the auxiliary light source;

comparing the determined voltage to a predetermined reference voltage to produce an error signal having a magnitude; and adjusting the phase of the control signal in accordance with the magnitude of the error signal.

24. The method according to claim 23 wherein the voltage source is an AC voltage and the determining step comprises the step of converting the AC voltage applied to the auxiliary light source to DC voltage, the DC voltage defining the determined voltage.

25. The method according to claim 22 wherein the auxiliary lighting system further comprises a control circuit that is responsive to the status signal, the control circuit outputting a control signal to control the switch circuit so as to configure the switch circuit in either the first state or the second state depending upon the state of energization of the HID lamp, the control circuit comprising a phase control circuit, the method further comprising the steps of:

monitoring variations in the voltage supply; and adjusting the phase of the control signal in accordance with the variations in the voltage supply.

* * * * *